US010876423B2

(12) United States Patent
Reynolds et al.

(10) Patent No.: US 10,876,423 B2
(45) Date of Patent: Dec. 29, 2020

(54) COMPRESSOR SECTION OF GAS TURBINE ENGINE INCLUDING HYBRID SHROUD WITH CASING TREATMENT AND ABRADABLE SECTION

(71) Applicant: HONEYWELL INTERNATIONAL INC., Morris Plains, NJ (US)

(72) Inventors: Bruce David Reynolds, Chandler, AZ (US); Nick Nolcheff, Chandler, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 80 days.

(21) Appl. No.: 16/235,876

(22) Filed: Dec. 28, 2018

(65) Prior Publication Data

US 2020/0208532 A1 Jul. 2, 2020

(51) Int. Cl.
*F01D 11/12* (2006.01)
*F04D 29/52* (2006.01)

(52) U.S. Cl.
CPC ..... *F01D 11/122* (2013.01); *F04D 29/526* (2013.01); *F05D 2220/323* (2013.01); *F05D 2240/11* (2013.01)

(58) Field of Classification Search
CPC ... F01D 11/122; F04D 29/526; F05D 2240/11
See application file for complete search history.

(56) References Cited

U.S. PATENT DOCUMENTS

| | | | | |
|---|---|---|---|---|
| 6,832,890 | B2 * | 12/2004 | Booth | F01D 5/20 415/173.1 |
| 8,257,022 | B2 | 9/2012 | Guemmer | |
| 8,337,146 | B2 * | 12/2012 | Yu | F01D 11/122 415/119 |
| 9,115,594 | B2 * | 8/2015 | Krautheim | F01D 11/10 |
| 9,353,632 | B2 * | 5/2016 | He | F01D 5/20 |
| 9,982,554 | B2 | 5/2018 | Perrot et al. | |
| 2007/0147989 | A1 * | 6/2007 | Collins | F04D 29/685 415/173.1 |
| 2008/0063508 | A1 | 3/2008 | Barnett | |
| 2009/0252596 | A1 | 10/2009 | Guemmer | |

(Continued)

FOREIGN PATENT DOCUMENTS

GB 2407343 A 4/2005

OTHER PUBLICATIONS

Ross, Mark H., et al., "Axial Compressor Stall, Circumferential Groove Casing Treatment, and the Tip-Clearance Momentum Flux," Journal of Propulsion and Power, vol. 34, No. 1, Jan.-Feb. 2018.

(Continued)

*Primary Examiner* — Ninh H. Nguyen
(74) *Attorney, Agent, or Firm* — Lorenz & Kopf, LLP

(57) ABSTRACT

A gas turbine engine includes a shroud with an abradable section and a non-abradable section that cooperatively define a shroud surface. The gas turbine engine also includes a rotor that is supported for rotation within the shroud to generate an aft axial fluid flow. The rotor includes a blade with a blade tip that is crowned and that opposes the abradable section and the non-abradable section of the shroud surface. A crown area of the blade tip opposes the abradable section. A casing treatment feature is provided in the non-abradable section of the shroud to oppose the blade tip of the rotor.

20 Claims, 5 Drawing Sheets

(56) References Cited

U.S. PATENT DOCUMENTS

| | | | |
|---|---|---|---|
| 2015/0003976 | A1 | 1/2015 | Zotz |
| 2018/0231023 | A1 | 8/2018 | Gentry |

OTHER PUBLICATIONS

Ross, Mark H., "Tip Clearance Flow Interaction with Circumferential Groove Casing Treatment in a Transonic Axial Compressor," A dissertation submitted to the Graduate School of the University of Notre Dame, Dec. 2013, downloaded from https://curate.nd.edu/show/vq27zk54d16 on Dec. 2018.

* cited by examiner

COMPRESSOR SECTION OF GAS TURBINE ENGINE INCLUDING HYBRID SHROUD WITH CASING TREATMENT AND ABRADABLE SECTION

TECHNICAL FIELD

The present disclosure generally relates to a compressor section of a gas turbine engine and, more particularly, to a compressor section including a hybrid shroud with a casing treatment and an abradable section.

BACKGROUND

Gas turbine engines are often used in aircraft, among other applications. For example, gas turbine engines used as aircraft main engines may provide propulsion for the aircraft but are also used to provide power generation. Such propulsion systems for aircraft must deliver high performance in a compact, lightweight configuration. This is particularly important in smaller jet propulsion systems typically used in regional and business aviation applications as well as in other turbofan, turboshaft, turboprop and rotorcraft applications.

The compressor section may be configured for increasing cycle pressure ratios to improve engine performance. Aerodynamic loading or stage counts may be increased, but these changes may reduce the compressor stall margin, causing engine instability, increased specific fuel consumption, and/or increased turbine operating temperatures.

Accordingly, there is a need for an improved compressor stage that achieves superior surge and stability margins and that maintains high efficiency potential for the gas turbine engine. There is also a need for an improved gas turbine engine with this type of compressor stage. Moreover, there is a need for improved methods of manufacturing these compressor stages for gas turbine engines. Furthermore, other desirable features and characteristics of the present disclosure will become apparent from the subsequent detailed description and the appended claims, taken in conjunction with the accompanying drawings and this background section.

BRIEF SUMMARY

In one embodiment, a gas turbine engine is disclosed that includes a shroud with an abradable section and a non-abradable section that cooperatively define a shroud surface. The gas turbine engine also includes a rotor that is supported for rotation within the shroud to generate an aft axial fluid flow. The rotor includes a blade with a blade tip that is crowned and that opposes the abradable section and the non-abradable section of the shroud surface. A crown area of the blade tip opposes the abradable section. A casing treatment feature is provided in the non-abradable section of the shroud to oppose the blade tip of the rotor.

In another embodiment, a method of manufacturing a compressor section of a gas turbine engine is disclosed. The method includes providing a case and applying an abradable material to the case to define an abradable section of a shroud surface. The abradable section is spaced apart in an axial direction from a non-abradable section of the shroud surface. The method also includes providing a casing treatment feature in the non-abradable section. Moreover, the method includes supporting a rotor for rotation within the case. The rotor includes a blade with a blade tip that is crowned and that opposes the abradable section and the non-abradable section of the shroud surface. A crown area of the blade tip opposes the abradable section.

In yet another embodiment, a compressor section of a gas turbine engine is disclosed. The compressor section includes a shroud with an abradable section and a non-abradable section cooperatively define a shroud surface. The compressor section also includes a rotor supported for rotation about a longitudinal axis. The rotor includes a blade with a blade tip that extends between a leading edge and a trailing edge of the blade. The blade tip opposes the abradable and non-abradable section of the shroud surface to define a clearance region between the blade tip and the shroud surface. A crown area of the blade tip opposes the abradable section. Furthermore, the compressor section includes a casing treatment feature that is recessed into the non-abradable section of the shroud surface to oppose the blade tip of the rotor. In a projection of the blade tip onto a longitudinal plane, a theta angle is defined between an imaginary axial line and an imaginary tangential line. The imaginary axial line is parallel to the longitudinal axis, and the imaginary tangential line is tangential to the blade tip. A change in the theta angle along the blade tip in a downstream direction is, at most, zero.

Furthermore, other desirable features and characteristics of the gas turbine engine will become apparent from the above background, the subsequent detailed description, and the appended claims, taken in conjunction with the accompanying drawings.

BRIEF DESCRIPTION OF THE DRAWINGS

The present disclosure will hereinafter be described in conjunction with the following drawing figures, wherein like numerals denote like elements, and wherein.

DETAILED DESCRIPTION

Figure 1:
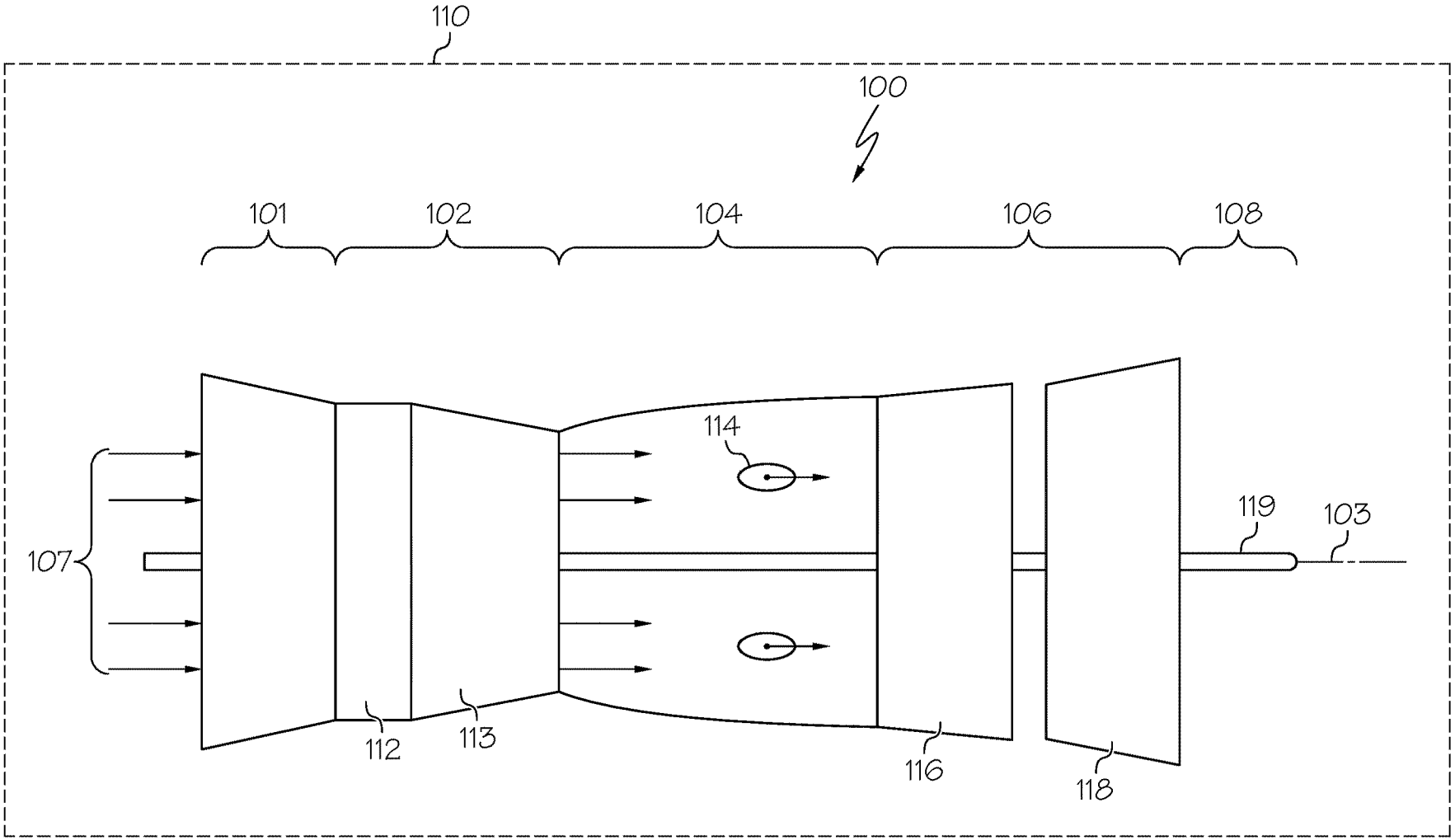
FIG. 1 is a schematic view of a gas turbine engine according to example embodiments of the present disclosure.

The following detailed description is merely exemplary in nature and is not intended to limit the present disclosure or the application and uses of the present disclosure. Furthermore, there is no intention to be bound by any theory presented in the preceding background or the following detailed description.

The present disclosure provides a turbomachine, such as a compressor section for a gas turbine engine. The compressor section includes a rotor blade with an outer radial edge or blade tip that radially opposes a shroud. In accordance with the present disclosure, the rotor tip geometry and opposing shroud configuration are configured to provide a uniquely robust compressor section that provides high efficiency and operability throughout a wide range of operating conditions—including "near-stall" conditions and conditions involving "rubbing" between the rotor blade and the shroud surface.

More specifically, during operations, the rotor may rotate and generate an aft axial (i.e., downstream) fluid flow through a clearance region defined between the rotor blades and the opposing shroud surface. The geometry of the clearance region provided by the configuration of the shroud and blade tip may increase the stall margin, decrease a deficit in axial fluid flow, and resist reverse axial fluid flow (i.e., leakage or upstream flow) during near-stall conditions.

In some embodiments, the rotor of the compressor section may include a plurality of rotor blades. At least one blade may include an outer radial edge or blade tip that is contoured with respect to the axis of rotation of the rotor. The radius at the outer radial edge (measured radially from the axis of rotation to the outer radial edge) may vary in the downstream direction along the blade tip. The radius proximate the leading edge may be less than the radius further downstream in the axial direction. In some embodiments, the outer radial edge may be crowned. For example, the outer radial edge may exhibit convex curvature from the leading edge to the trailing edge. An area of the outer radial edge having the greatest radius (i.e., a "crown area") may be included in an intermediate axial position between the leading edge and the trailing edge.

The compressor section may also include a hybrid shroud with a plurality of features that increase stall margin while maintaining high operating efficiency of the compressor section. Specifically, the shroud may have a geometry that corresponds to that of the blade tip. For example, the shroud and the blade tip may cooperatively define a crowned clearance area therebetween. Leading edge radial clearance and trailing edge radial clearance between the blade tip and the shroud may be greater than the radial clearance at an intermediate area (a crown area) of the blade tip. Also, the radial clearance between the shroud and the blade tip may be relatively small axially across the clearance region to maintain high operating efficiency of the compressor section. This crowned-shape clearance area may create a more open clearance proximate the leading edge, a smaller clearance at the crown area of the blade tip, a more open clearance proximate the trailing edge.

Additionally, the shroud may include a non-abradable section and an abradable section that define different axial portions of a shroud surface. A majority of the shroud, including the non-abradable section, may be defined by a base material such as solid metal. The abradable section may be formed from a second material and/or formed with a second constructions, such as a material with a lower density and/or lower wear resistance than the base material. Axial ends of the abradable section may be embedded within the base material of the shroud to ensure that the abradable section is robustly attached to the base material of the shroud.

The blade tip may oppose the non-abradable and the abradable section of the shroud. The rotor and shroud may be arranged such that the crown area of the blade tip (i.e., the area with the least amount of clearance) opposes the abradable section of the shroud surface. Thus, if the crown area contacts or "rubs" against the shroud surface, the abradable material of the abradable section may wear away without detrimentally affecting performance of the compressor section.

Furthermore, the shroud may include at least one casing treatment that resists a reverse axial fluid flow during near-stall conditions of the compressor section. In other words, rotation of the rotor generates the of axial fluid flow while increasing the fluid's pressure. It will be appreciated that a deficit may exist in the aft axial fluid flow's velocity due to friction along the shroud or due to inlet distortion. Further, in proximity to the shroud, a clearance region is formed between the blade tip and the shroud surface. Fluid flow that traverses this clearance region may contribute to the deficit in aft axial velocity. These debits to aft axial fluid flow may result in a reduction in compressor stability. However, the casing treatments included in the hybrid shroud of the present disclosure reduce these deficits. The casing treatments of the present disclosure increase the stall margin of the compressor section.

The casing treatment may be one of a plurality of different types of features without departing from the scope of the present disclosure. For example, the casing treatment may include at least one groove, channel, pocket, dimple or other aperture that is recessed into the shroud surface, a honeycomb structure that partly defines the shroud surface, a suction device, a blowing device, an active clearance control device, and a plasma flow control device.

The casing treatment may be formed within, supported by, and/or otherwise provided in the non-abradable section. As such, the casing treatment may be robust and effective at resisting the reverse axial fluid flow.

Methods of manufacturing the compressor stage and/or other components of the gas turbine engine are also disclosed. Accordingly, the present disclosure provides convenient and effective methods of manufacturing these components.

Turning now to FIG. 1, a functional block diagram of an exemplary gas turbine engine 100 is depicted. The engine 100 may be included on a vehicle 110 of any suitable type, such as an aircraft, rotorcraft, marine vessel, train, or other vehicle, and the engine 100 can propel or provide auxiliary power to the vehicle 110.

In some embodiments, the depicted engine 100 may be a single-spool turbo-shaft gas turbine propulsion engine. The engine 100 may generally include an intake section 101, a compressor section 102, a combustion section 104, a turbine section 106, and an exhaust section 108, which are arranged sequentially along a longitudinal axis 103. A downstream direction through the engine 100 may be defined generally along the axis 103 from the intake section 101 to the exhaust section 108. Conversely, an upstream direction is defined from the exhaust section 108 to the intake section 101.

The intake section 101 may receive an intake airstream indicated by arrows 107 in FIG. 1. The compressor section 102, may include one or more compressor stages that draw air 107 downstream into the engine 100 and compress the air 107 to raise its pressure. In the depicted embodiment, the compressor section 102 includes two stages: a low pressure compressor stage 112 and a high pressure compressor stage 113. The compressor stages 112, 113 may be disposed sequentially along the axis 103 with the low pressure compressor stage 112 disposed upstream of the high pressure compressor stage 113. It will be appreciated that the engine 100 could be configured with more or less than this number of compressor stages.

The compressed air from the compressor section 102 may be directed into the combustion section 104. In the combustion section 104, which includes a combustor assembly 114, the compressed air is mixed with fuel supplied from a non-illustrated fuel source. The fuel-and-air mixture is combusted in the combustion section 104, and the high energy combusted air mixture is then directed into the turbine section 106.

The turbine section 106 includes one or more turbines. In the depicted embodiment, the turbine section 106 includes two turbines: a high pressure turbine 116 and a low pressure turbine 118. However, it will be appreciated that the engine 100 could be configured with more or less than this number of turbines. No matter the particular number, the combusted air mixture from the combustion section 104 expands through each turbine 116, 118, causing it to rotate a power shaft 119. The combusted air mixture is then exhausted via the exhaust section 108. The power shaft 119 may be used to drive various devices within the engine 100 and/or within the vehicle 110.

Figure 2:
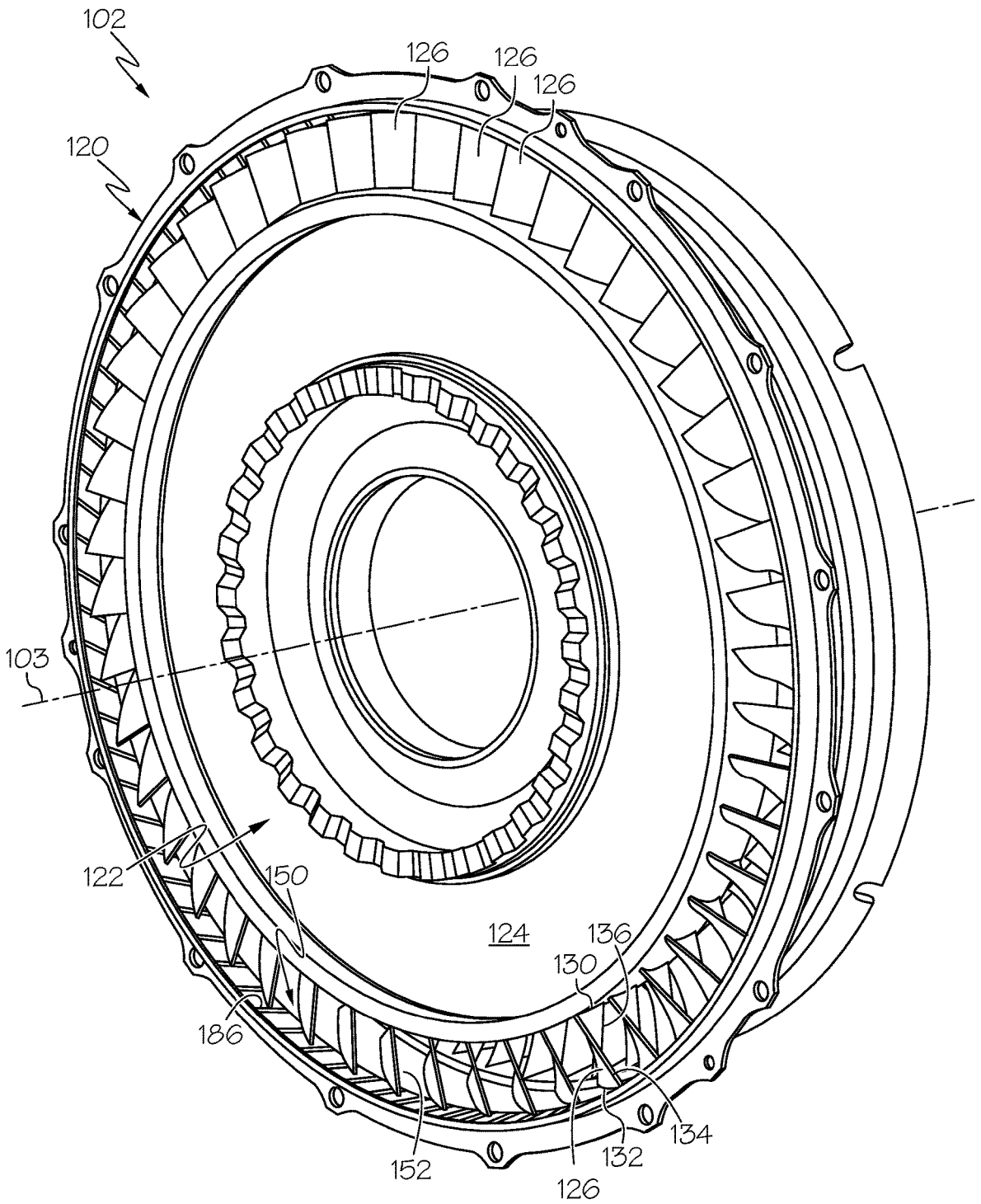
FIG. 2 is a perspective view of a compressor stage of the gas turbine engine of FIG. 1 according to example embodiments.
Figure 3:
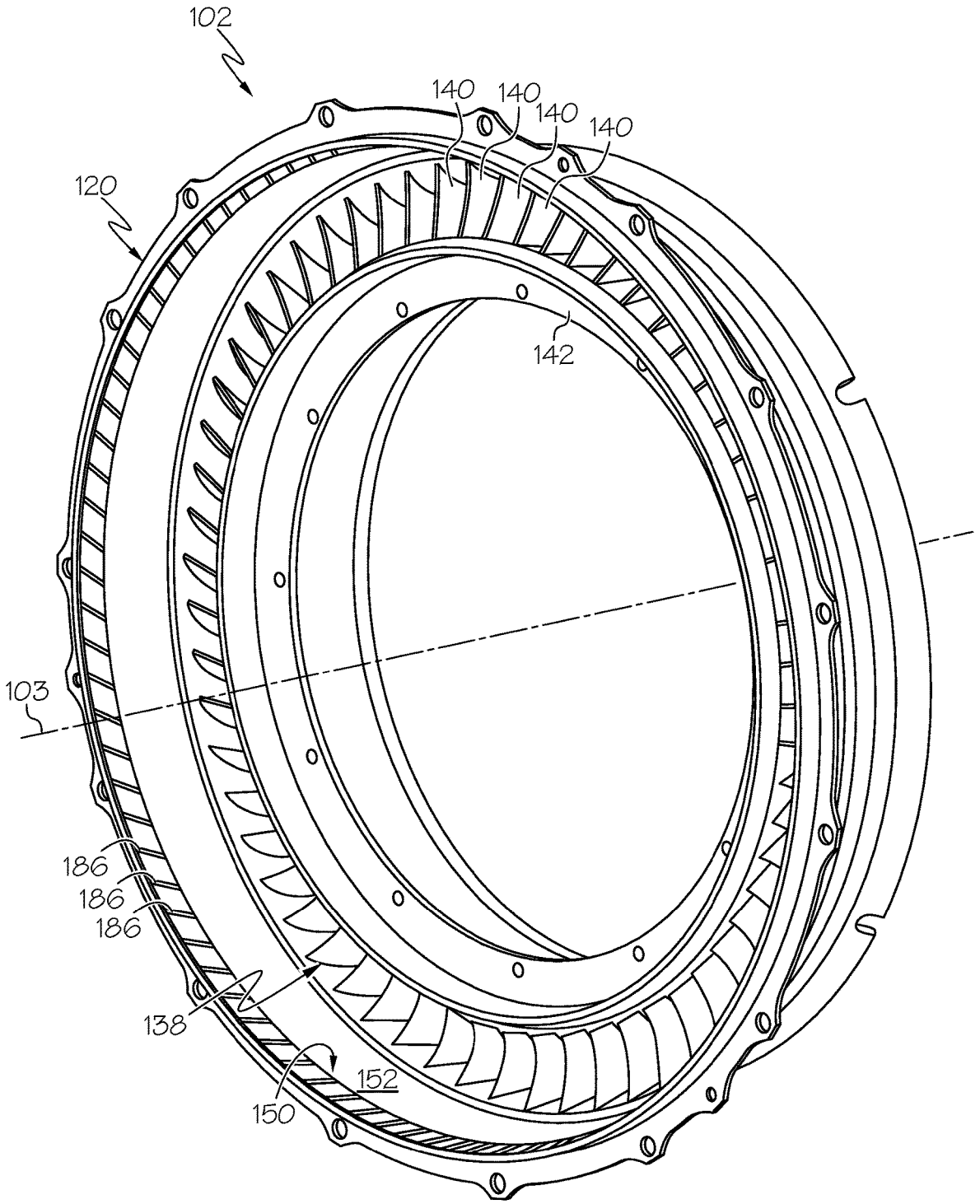
FIG. 3 is a perspective view of the compressor stage of FIG. 2 with the rotor hidden.

Referring now to FIGS. 2 and 3, the compressor section 102 will be discussed in greater detail according to example embodiments of the present disclosure. Specifically, the low pressure compressor stage 112 is shown as an example; however, it will be appreciated that the features described may be included in the high pressure compressor stage 113.

The compressor section 102 may include a case 120. The case 120 may be hollow and cylindrical in some embodiments. The case 120 may also include a shroud 150 with a shroud surface 152 (e.g., an inner diameter surface of the shroud 150).

The compressor section 102 may also include a rotor 122. The rotor 122 may include a wheel 124. The wheel 124 may be supported on the shaft 119 (FIG. 1), which is hidden in FIGS. 2 and 3 for purposes of clarity. The wheel 124 may be centered on the axis 103. The rotor 122 may further include a plurality of blades 126, which extend radially from the wheel 124 and which may be spaced apart in a circumferential direction about the axis 103. The blades 126 of the rotor 122 may radially oppose the shroud surface 152. The rotor 122, including the wheel 124 and the plurality of blades 126, may rotate about the axis 103 relative to the case 120, the shroud 150, and the shroud surface 152 to generate an aft axial fluid flow through the compressor section 102 as will be discussed.

As shown in FIG. 3, the compressor section 102 may additionally include a stator 138. (The rotor 122 is hidden from view in FIG. 3 so as to reveal the stator 138.) The stator 138 may include a plurality of stationary blades 140 and one or more support structures 142 that support the blades 140 in a fixed position on the case 120. The stator 138 may be disposed downstream of the wheel 124 and blades 126 of the rotor 122, and the stator 138 may direct air from the blades 126 further downstream through the engine 100.

As indicated on a representative blade 126 in FIG. 2, an inner radial end 130 is fixedly attached to the outer diameter of the wheel 124. The blade 126 also includes an outer radial edge or blade tip 132. The blade tip 132 is radially spaced apart from the inner radial end 130. The blade 126 further includes a leading edge 134, which extends radially between the inner radial end 130 and the blade tip 132. Furthermore, the blade 126 includes a trailing edge 136, which extends radially between the inner end and the blade tip 132, and which is spaced downstream of the leading edge 134 relative to the longitudinal axis 103. The blade tip 132 extends between the leading edge 134 and the trailing edge 136 extends generally along the longitudinal axis 103. As shown in FIG. 2, the blades 126 may exhibit complex, three-dimensional curved surfaces and may be shaped so as to have a degree of helical twist about its respective radial axis and/or sweeping curvature in the downstream direction.

Figure 4:
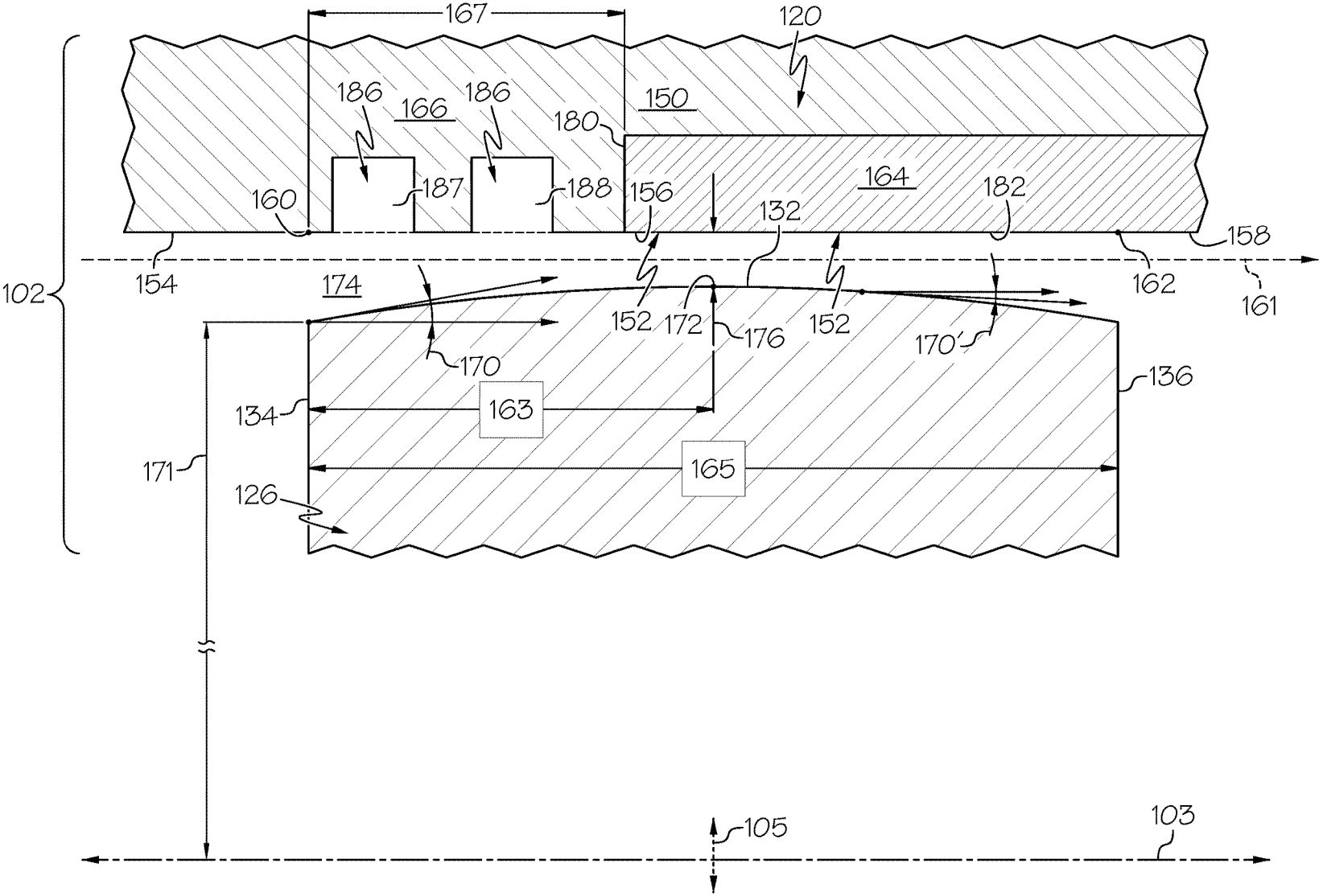
FIG. 4 is a section view of the compressor stage of FIG. 2 according to example embodiments.

Referring now to FIG. 4, the compressor section 102 will be discussed in greater detail according to example embodiments. The shroud 150 of the case 120 is shown in section view, and the blade 126 is shown with its outer profile (including the leading edge 134, the trailing edge 136, and the blade tip 132) projected onto a longitudinal plane (i.e., the plane of the paper). A radial axis 105 is also shown for reference purposes as well.

The leading edge 134 and the trailing edge 136 may extend radially and may be substantially parallel to the radial axis 105 in some embodiments. Also, the blade tip 132 may exhibit a certain contour that advantageously affects fluid flow through the compressor section 102. In other words, a radius 171 of the blade tip 132 (measured from the axis 103 to the blade tip 132 along the radial axis 105) may vary along the axis 103.

The blade tip 132 may be crowned as shown in FIG. 4. For example, the radius 171 of the blade tip 132 downstream axially from the leading edge 134 may gradually increase. Also, in some embodiments, the radius 171 of the blade tip 132 further downstream axially may gradually decrease toward the trailing edge 136. In the illustrated embodiment, for example, the radius 171 may gradually change continuously in the axial direction between the leading edge 134 and the trailing edge 136. As shown, the profile of the blade tip 132 may contour convexly continuously along the longitudinal axis 103 from the leading edge 134 to the trailing edge 136.

In some embodiments, the blade tip 132 may define a crown area 172. The crown area 172 may represent an area or point on the blade tip 132 at which the radius 171 is at a maximum. As represented in FIG. 4, the crown area 172 may represent an apex of the crowned outer profile of the blade tip 132 with respect to the axis 103. Thus, the blade tip 132 may decrease in radius 171 in the upstream and downstream directions from the crown area 172. However, it will be appreciated that the blade tip 132 may be configured differently without departing from the scope of the present disclosure. For example, the blade tip 132 may be chamfered and the profile of the blade tip 132 may be convexly contoured from the leading edge 134 to the crown area 172 in some embodiments, and the radius 171 may remain substantially constant from the crown area 172 in the longitudinal direction. In some embodiments, the radius 171 may remain substantially constant from the crown area 172 to the trailing edge 136.

Furthermore, the shroud 150 may be an annular component. In some embodiments represented in FIGS. 2-4, the shroud 150 may have a radius (measured from the axis 103) that remains substantially constant along the axis 103. However, in other embodiments of the present disclosure (e.g., the embodiment of FIG. 5), the shroud may be tapered such that the radius varies longitudinally.

The shroud 150 may define the shroud surface 152 on an inner diameter thereof. The shroud surface 152 may be centered about the axis 103. Additionally, the shroud surface 152 may be sub-divided relative to the blade 126 so as to include an upstream region 154, an opposing region 156, and a downstream region 158. The upstream region 154 of the shroud surface 152 may be disposed upstream of the blade 126. The opposing region 156 of the shroud surface 152 may directly oppose (in the radial direction) the blade tip 132. The downstream region 158 may be disposed downstream of the blade 126. A forward border 160 separates the upstream region 154 from the opposing region 156 in FIG. 2, and an aft border 162 separates the opposing region 156 from the downstream region 158.

A clearance region 174 is defined between the blade tip 132 and the opposing region 156 of the shroud surface 152. A clearance dimension 176 (measured radially between the shroud surface 152 and the blade 126) may vary along the longitudinal axis 103 from the leading edge 134 to the trailing edge 136. The clearance region 174 may have a crowned or crown-like shape. In this case, the term "crowned" is used to define the difference between the minimum tip gap clearance 176 (at the crown area 172) and the maximum tip gap clearance 176 upstream of the crown area 172. Also, it will be appreciated that the clearance region 174 may be crowned when at the design operating condition of the compressor, which for an aircraft propulsion engine, would be a sea-level takeoff, cruise, or approach condition.

The clearance dimension 176 proximate the crown area 172 (a crown clearance dimension) may be smaller than the clearance dimension 176 proximate the leading edge 134 (a leading clearance dimension). Likewise, the clearance dimension 176 proximate the crown area 172 may be smaller than the clearance dimension 176 proximate the trailing edge 136. In some embodiments, the clearance dimension 176 within the opposing region 156 may be smallest at the crown area 172. Furthermore, in some embodiments, the clearance dimension 176 at the crown area 172 may be between approximately forty percent (40%) to sixty percent (60%) of the clearance dimension 176 at the leading edge 134.

The rotor 122 may be supported for rotation about the axis 103 to generate the aft axial fluid flow through the clearance region 174 (in a downstream direction) from the leading edge 134 to the trailing edge 136. The aft axial fluid flow, directed in the downstream direction, is represented by arrow 161 in FIG. 4.

The blade tip 132 may define a theta angle 170 between: 1) an imaginary axial line that is directed downstream and parallel to the axis 103; and 2) an intersecting imaginary tangential line that is directed generally downstream and tangent to the blade tip 132. A first theta angle (a leading edge theta angle at the leading edge 134) is indicated at 170 as an example. Also, a second theta angle (an intermediate theta angle disposed longitudinally between the leading edge 134 and the trailing edge 136) is indicated in FIG. 4 at 170'.

The theta angle 170 may be a positive angle at the leading edge 134, and the theta angle 170' may be a negative angle further downstream. More specifically, if the axial line defining the theta angle 170 represents zero degrees, then the tangential line defining the theta angle 170 is spaced at a positive angle therefrom; in contrast, if the axial line defining the theta angle 170' represents zero degrees, then the tangential line defining the theta angle 170' is spaced at a negative angle therefrom. Thus, those having ordinary skill in the art will understand that the theta angle 170 may change along the blade tip 132 in the downstream direction relative to the axis 103. The theta angle 170 may gradually change along the blade tip 132. Also, in some embodiments, there may be a higher degree of change proximate the leading edge 134 than proximate the trailing edge 136. In some embodiments (e.g., the embodiment of FIG. 4), the theta angle 170 may change continuously along an entirety of the blade tip 13 in the downstream direction.

However, in some embodiments, the theta angle 170 either remains constant or decreases along the blade tip 132 in the downstream direction. Stated differently, the change in the theta angle 170 along the blade tip 132 in the downstream direction may be, at most, zero. In the embodiment of FIG. 4, for example, the theta angle 170 does not increase in the downstream direction. Instead, the theta angle 170 continuously decreases along the blade tip 132 in the downstream direction.

Specifically, as shown in FIG. 4, the theta angle 170 may be a positive angle at the leading edge 134. This may be the area at which the theta angle 170 of the blade tip 132 is greatest. Moving downstream along the blade tip 132 away from the leading edge 134, the theta angle 170 may gradually decrease. The theta angle 170 may be approximately zero degrees (0°) proximate the crown area 172. Moving even further downstream on the blade tip 132, the theta angle 170 may gradually decrease even further until reaching the trailing edge 136.

It will be appreciated, however, that the embodiment of FIG. 4 is merely an example and the blade tip 132 may be configured differently without departing from the scope of the present disclosure. For example, in additional embodiments, there may be regions along the blade tip 132 in which the theta angle 170 remains constant in the downstream direction. This may be embodied in a blade tip 132 that is convexly contoured proximate the leading edge 134 and that runs substantially parallel with the axis 103 further downstream.

Furthermore, the shroud 150 may include an abradable section 164 and a non-abradable section 166. In some embodiments, the majority of the shroud 150 may be defined by a first material (i.e., a base material) of the non-abradable section 166, whereas the abradable section 164 may be constructed of a different material and/or construction that defines a minority of the shroud 150. The first material of the non-abradable section 166 may be formed of solid metal with high hardness, whereas the abradable section 164 may be constructed of a porous material with lower hardness. Also, the abradable section 164 may be formed of a composite material with a matrix that wears away, for example, when contacted by the blade tip 132.

The abradable section 164 may be embedded within the non-abradable section 166. For example, the abradable section 164 may be an insert that is disposed within a recess, groove, or other aperture of the non-abradable section 166. The abradable section 164 may have a substantially rectangular cross section (FIG. 4), and this cross section may extend in the circumferential direction about the axis 103. Also, as shown in FIG. 4, the abradable section 164 may include an upstream end 180 and an inner diameter surface 182. The abradable section 164 may also include a downstream end that is similar to the upstream end 180, but that is disposed downstream therefrom. The upstream end 180 may be recessed below the shroud surface 182 and embedded within the base material of the non-abradable section 166 such that the inner diameter surface 182 is exposed and flush with the abradable section 164 disposed immediately upstream. Accordingly, the abradable section 164 and the non-abradable section 166 may cooperatively define the shroud surface 152 of the shroud 150.

Also, the non-abradable section 166 and the abradable section 164 may define the opposing region 156 of the shroud surface 152 such that parts of the abradable section 164 and the non-abradable section 166 oppose the blade tip 132. Also, in some embodiments, the non-abradable section 166 may be disposed upstream of the abradable section 164 with respect to the axis 103. Specifically, the non-abradable section 166 may define the upstream region 154 and part of the opposing region 156 of the shroud surface 152. Conversely, the abradable section 164 may define part of the opposing region 156 and the downstream region 158 of the shroud surface 152.

Furthermore, the blade 126 may be disposed relative to the shroud surface 152 such that the crown area 172 radially opposes the abradable section 164. Also, the crown area 172 may be disposed axially downstream of the end 180 of the abradable section 164 (i.e., the crown area 172 may be disposed downstream of the non-abradable section 166). This ensures that, should the blade tip 132 contact the shroud 150, the blade tip 132 will contact abradable material that will wear away with little to no effect on operations of the compressor section 102. Furthermore, because the upstream end 180 is embedded within the non-abradable portion 166, the upstream end 180 is protected from chipping away. Accordingly, the compressor section 102 may be very robust.

Moreover, the shroud 150 may include a casing treatment 186. The casing treatment 186 is configured to resist a reverse axial fluid flow (i.e., in a direction opposite the arrow 161) during near-stall operating conditions of the compressor section 102. In other words, the casing treatment 186 increases the stall margin of the compressor section 102 and/or reduces the deficit in the axial fluid flow, especially proximate the leading edge.

As shown in FIGS. 2 and 3, the casing treatment 186 may include one or more grooves that are recessed radially into the shroud surface 152. As shown in the embodiment of FIGS. 2 and 3, grooves may be elongated, extending axially as well as circumferentially about the axis 103. However, as detailed above, the casing treatment 186 may be another feature without departing from the scope of the present disclosure (e.g., another aperture that is recessed into the shroud surface 152, a honeycomb structure that partly defines the shroud surface 152, a suction device, a blowing device, an active clearance control device, and a plasma flow control device).

In another embodiment represented in FIG. 4, the casing treatment 186 may include a first groove 187 and a second groove 188 recessed radially into the shroud surface 152. In some embodiments, the first and second grooves 187, 188 may have a rectangular (e.g., square) cross section, and this cross section of the grooves 187, 188 may extend circumferentially about the axis 103. Thus, these may be considered circumferential grooves. It will be appreciated, however, that at least one groove 187, 188 may have a triangular or wedge-shaped cross section. Furthermore, the major axis of the first and/or second grooves may extend generally parallel to the axis 103. Also, at least one groove 187, 188 may extend helically about the axis 103 or in another direction with respect to the axis 103.

Moreover, the casing treatment 186 (i.e., the first and second grooves 187, 188) may be provided in the non-abradable section 166 of the shroud 150 and partly within the opposing region 156 of the shroud surface 152 to radially oppose the blade tip 132 proximate the leading edge 134. Accordingly, the grooves 187, 188 may resist the reverse axial fluid flow during near-stall operating conditions. Also, because the grooves 187, 188 are provided in the non-abradable section 166, the grooves 187, 188 are unlikely to wear away, and the compressor section 102 may be very robust. Likewise, where the casing treatment 186 includes a plasma control device, electrodes may be disposed within and supported by the non-abradable section 166. These electrodes may be fixedly and robustly attached to the non-abradable section and may generate a voltage that ionizes the air, and the ionized air may be directed downstream via a selectively controlled electric field.

Moreover, the compressor section 102 has a "max crown fraction (MCF)," where:

$$\mathrm{MCF}=MCD/Cx \tag{1}$$

where MCD is equal to the axial distance from the leading edge 134 to the crown area 172 (indicated at 163), and where Cx is the axial chord length of the blade 126 (indicated at 165). In some embodiments, MCF of the compressor section 102 may be a value between 0.33 and 0.62. This construction may provide ample space for one or more casing treatments 186 and the abradable section 164 and enhances manufacturability.

Furthermore, in some embodiments, the compressor section 102 has a "crown transition length (CTL)," where:

$$\mathrm{CTL}=\mathrm{LEL}/MCD \tag{2}$$

where LEL is a leading edge zone length equal to the axial distance from the leading edge 134 to the upstream end 180 of the abradable section 164 (indicated at 167), and where MCD is equal to the axial distance from the leading edge 134 to the crown area 172 (indicated at 163). In some embodiments, CTL of the compressor section 102 may be a value between 0.60 to 0.90. This construction may provide ample space for one or more casing treatments 186 and the abradable section 164 and enhances manufacturability.

The compressor section 102 may be manufactured in various ways. For example, the case 120 may be formed initially. Portions of the non-abradable section 166 may be formed as a metallic cylinder. Then, the grooves 187, 188 may be formed, for example, by cutting or otherwise removing material. Next, the abradable section 164 may be inserted, embedded, attached, or otherwise provided to substantially complete the shroud 150. Subsequently, upon installation of the rotor 122, the blades 126 may be axially positioned as represented in FIG. 4 with the blade tips 132 opposing the hybrid shroud 150.

It will be appreciated, however, that manufacturing may occur differently without departing from the scope of the present disclosure. For example, parts of the shroud 150 may be additively manufactured (e.g., 3-D printing). Specifically, the non-abradable section 166 may be additively manufactured to include the grooves 187, 188, and then the abradable section 164 may be attached and the rotor 122 positioned within the shroud 150. In another example, the shroud 150 may be additively manufactured to include the grooves 187, 188 (or other casing treatment 186) as well as the abradable section 164, and then the rotor 122 may be positioned within the shroud 150.

Figure 5:
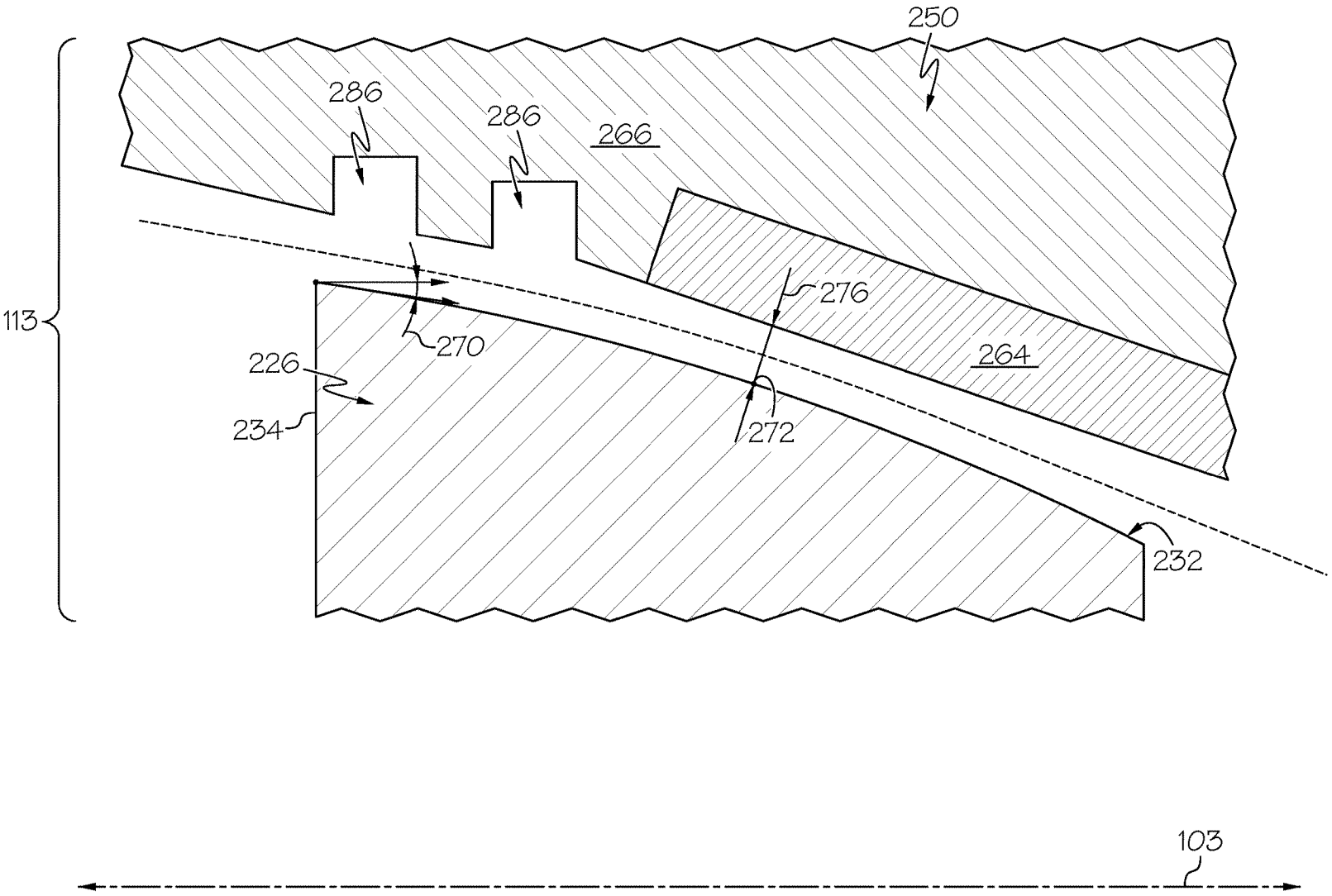
FIG. 5 is a section view of a compressor stage of FIG. 1 according to additional example embodiments.

Referring now to FIG. 5, the compressor section is illustrated according to additional embodiments of the present disclosure. For example, the compressor section of FIG. 5 may represent the high-pressure compressor stage 113 of FIG. 1. The compressor section of FIG. 5 may correspond to the embodiments of FIG. 4 except as noted. Components that correspond to those of FIG. 4 are indicated with corresponding reference numbers increased by 100.

In some embodiments, the shroud 250 may be tapered. For example, the shroud 250 may taper such that the diameter gradually reduces in the downstream direction along the axis 103. Furthermore, the blade tip 232 may be crowned. In some embodiments, the theta angle 270 at the leading edge 234 may be a negative angle. The theta angle 270 may gradually reduce along the blade tip 232 in the downstream direction.

Like the embodiment of FIG. 4, the crown area 272 of the blade 226 may oppose the abradable section 264. The casing treatment 286 (e.g., grooves) may be included in the non-abradable section 266.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It is understood that various changes may be made in the function and arrangement of elements described in an exemplary embodiment without departing from the scope of the present disclosure as set forth in the appended claims.

What is claimed is:

1. A gas turbine engine comprising:

a shroud with an abradable section and a non-abradable section that cooperatively define a shroud surface;

a rotor that is supported for rotation about a longitudinal axis within the shroud to generate an aft axial fluid flow, the rotor including a blade with a blade tip that extends axially between a leading edge and a trailing edge of the blade, that is crowned and that opposes the abradable section and the non-abradable section of the shroud surface, a crown area of the blade tip opposing the abradable section; and a casing treatment feature that is provided in the non-abradable section of the shroud to oppose the blade tip of the rotor;

wherein, in a projection of the blade tip onto a longitudinal plane, a theta angle is defined between an imaginary axial line and an imaginary tangential line, the imaginary axial line being parallel to the longitudinal axis, the imaginary tangential line being tangential to the blade tip; and wherein a change in the theta angle along the blade tip in a downstream direction is, at most, zero.

2. The gas turbine engine of claim 1, wherein a clearance region is defined between the blade tip and the shroud surface;

wherein a crown clearance dimension measured between the shroud surface and the blade tip at the crown area is less than a leading clearance dimension and a trailing clearance dimension, the leading clearance dimension measured between the shroud surface and the blade tip proximate the leading edge, the trailing clearance dimension measured between the shroud surface and the blade tip proximate the trailing edge.

3. The gas turbine engine of claim 2, wherein the crown area clearance dimension is between approximately forty percent (40%) to sixty percent (60%) of the leading edge clearance dimension.

4. The gas turbine engine of claim 2, wherein the blade tip has a radius that changes continuously from the leading edge to the trailing edge.

5. The gas turbine engine of claim 1, wherein the shroud has a radius that remains substantially constant in a downstream direction relative to the longitudinal axis.

6. The gas turbine engine of claim 1, wherein the shroud radially tapers in a downstream direction relative to the longitudinal axis.

7. The gas turbine engine of claim 1, wherein the theta angle proximate the leading edge is a positive angle.

8. The gas turbine engine of claim 1, wherein the theta angle proximate the leading edge is a negative angle.

9. The gas turbine engine of claim 1, wherein the theta angle changes continuously along an entirety of the blade tip in the downstream direction.

10. The gas turbine engine of claim 1, wherein the shroud includes a base material;

wherein the base material defines the non-abradable section of the shroud;

wherein the abradable section includes an upstream end and an inner diameter surface, the upstream end being embedded within the base material, and the inner diameter surface being exposed from the base material to partly define the shroud surface.

11. The gas turbine engine of claim 1, wherein the casing treatment includes at least one of an aperture that is recessed into the shroud surface, a honeycomb structure that partly defines the shroud surface, a suction device, a blowing device, an active clearance control device, and a plasma flow control device.

12. The gas turbine engine of claim 1, wherein the blade tip opposes the shroud surface to cooperatively define a clearance region therebetween, the clearance region having a flow axis;

wherein the abradable section includes an upstream end; and wherein the crown area is disposed downstream of the upstream end relative to the flow axis.

13. A compressor section of a gas turbine engine comprising:

a shroud with an abradable section and a non-abradable section that cooperatively define a shroud surface;

a rotor that is supported for rotation about a longitudinal axis, the rotor including a blade with an blade tip that extends between a leading edge and a trailing edge of the blade, the blade tip opposing the abradable and non-abradable section of the shroud surface to define a clearance region between the blade tip and the shroud surface, a crown area of the blade tip opposing the abradable section;

a casing treatment feature that is recessed into the non-abradable section of the shroud surface to oppose the blade tip of the rotor;

wherein, in a projection of the blade tip onto a longitudinal plane, a theta angle is defined between an imaginary axial line and an imaginary tangential line, the imaginary axial line being parallel to the longitudinal axis, the imaginary tangential line being tangential to the blade tip; and wherein a change in the theta angle along the blade tip in a downstream direction is, at most, zero.

14. The compressor section of claim 13, wherein the theta angle proximate the leading edge is a positive angle.

15. The compressor section of claim 13, wherein the theta angle proximate the leading edge is a negative angle.

16. The compressor section of claim 13, wherein the theta angle changes continuously across an entirety of the blade tip in the downstream direction.

17. The compressor section of claim 13, wherein the shroud includes a base material;

wherein the base material defines the non-abradable section of the shroud;

wherein the abradable section includes an upstream end, a downstream end, and an inner diameter surface, the upstream end and the downstream end being embedded within the base material, and the inner diameter surface being exposed from the base material to partly define the shroud surface.

18. A gas turbine engine comprising:

a shroud with an abradable section and a non-abradable section that cooperatively define a shroud surface;

a rotor that is supported for rotation within the shroud to generate an aft axial fluid flow, the rotor including a blade with a blade tip that extends axially between a leading edge and a trailing edge, that is crowned, and that opposes the abradable section and the non-abradable section of the shroud surface, a crown area of the blade tip opposing the abradable section, a clearance region being defined between the blade tip and the shroud surface;

a casing treatment feature that is provided in the non-abradable section of the shroud to oppose the blade tip of the rotor; and a crown clearance dimension measured between the shroud surface and the blade tip at the crown area being less than a leading clearance dimension and a trailing clearance dimension, the leading clearance dimension measured between the shroud surface and the blade tip proximate the leading edge, the trailing clearance dimension measured between the shroud surface and the blade tip proximate the trailing edge, the crown area clearance dimension being between approximately forty percent (40%) to sixty percent (60%) of the leading edge clearance dimension.

19. The gas turbine engine of claim 18, wherein the blade tip has a radius that changes continuously from the leading edge to the trailing edge.

20. The gas turbine engine of claim 18, wherein the clearance region has a flow axis;

wherein the abradable section includes an upstream end; and wherein the crown area is disposed downstream of the upstream end relative to the flow axis.

* * * * *